US005661252A

United States Patent [19]

Krawczak

[11] Patent Number: 5,661,252

[45] Date of Patent: Aug. 26, 1997

[54] ACOUSTIC ARM

[76] Inventor: Kazimierz Marian Krawczak, 63 Marshall Ave., Warwick, R.I. 02886

[21] Appl. No.: 628,942

[22] Filed: Apr. 8, 1996

[51] Int. Cl.[6] ..... G10D 3/00

[52] U.S. Cl. ..... 84/291; 84/293; 84/294; 84/297 R

[58] Field of Search ..... 84/291, 293, 297 R, 84/312 R

[56] References Cited

U.S. PATENT DOCUMENTS 5,347,904 9/1994 Lawrence ..... 84/291
5,567,896 10/1996 Gottschall ..... 84/294

*Primary Examiner*—Michael L. Gellner
*Assistant Examiner*—Shih-Yung Hsieh

[57] ABSTRACT

Improved dynamic-acoustic system of guitar (X) with soundbox (184), creates a better scheme of dynamic forces cooperating with soundboard (168) of guitar (X). This system makes it possible for the top to vibrate more freely, producing a full, open tone. Through the use of additional energy, resulting from moving the string attachment from soundboard (168) onto acoustic arm (10), the soundboard (168) is not put under string tension, as in standard flat top, classical, or arch-top guitars. Allowing much lighter braces to be used without a imploding or exploding soundboard (168). Acoustic arm (10) is a simple mechanical element attached to neck (82) of guitar (X), creating its extension inside soundbox (184). Neck (82) with attached acoustic arm (10), is installed in top block (74). Next, neck (82) attached with two bolts (100) and (124) to soundbox (184), creates a separable, rigid construction of guitar (X). Relocation of the string attachment onto acoustic arm (10), frees up more applications of this instrument, related to sound, length of life, production, and conservation of the guitar. The use of simple separable connection of neck (82) and block (74), will significaly reduce the execution time of certain technological operations in guitar production. Locating the acoustic arm (10) with neck (82) in soundbox (184), using two bolts, is a simple operation, with does not require special training of the employees.

1 Claim, 6 Drawing Sheets

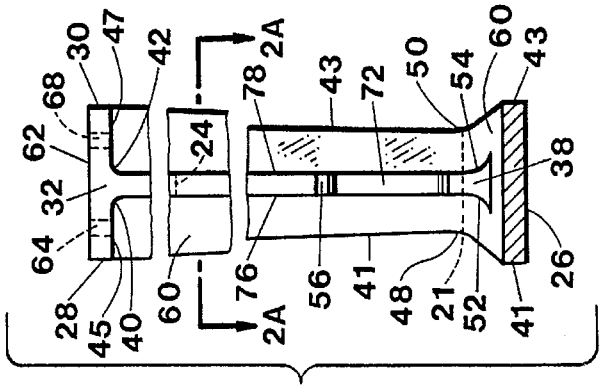
FIG. 2
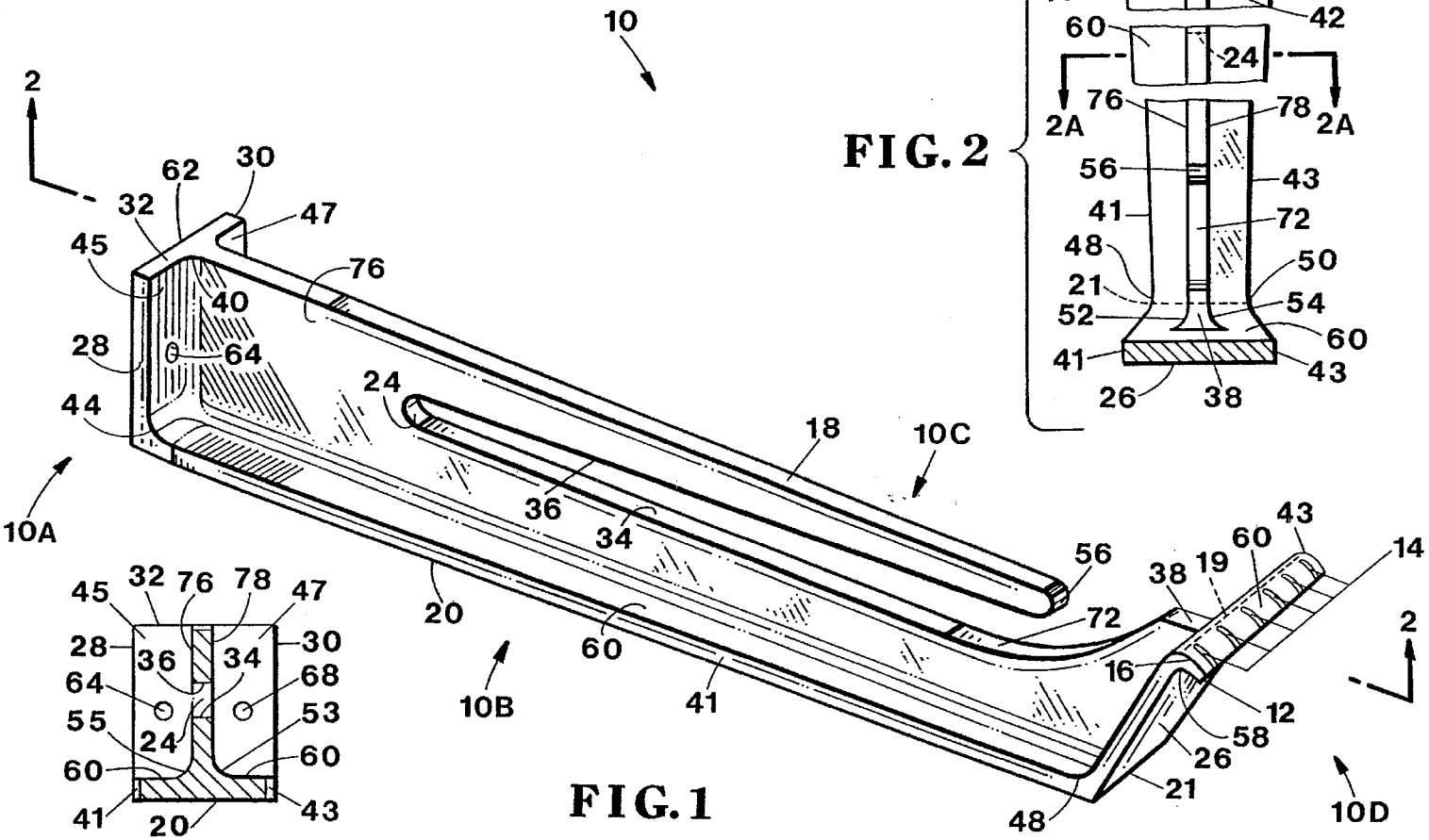
FIG. 1
FIG. 2A

ACOUSTIC ARM

BACKGROUND

FIELD OF INVENTION

This invention relates to acoustic guitars, specifically to an improved dynamic-acoustic system those musical instruments.

BACKGROUND OF THE INVENTION

From the time of implementation of metal strings witch musical instrument called guitar, a combination was created and named acoustic guitar. The construction of an acoustic guitar with metal strings attached to the soundboard, creates unwanted side effects which cause:

(a) deformation of the soundboard (b) frequent out of tuning during play (c) unused portion of soundboard working energy Above mentioned negative side effects of the acoustic guitar are not adequately noticed and appreciated by most of people. According to the above, chances of purchasing a guitar closer to perfection will not increase until, above mentioned side effects will be improved or eliminated.

OBJECTS AND ADVANTAGES

Accordingly, several objects and advantages of this invention are:

(a) separate strings attachments from the soundboard, (b) optimal usage of the guitar soundboard energy, during its usage.

Other objects and advantages are:

(c) straightforward system of separable connection between the neck and soundbox of the guitar, which makes the installation of the invention facile, (D) adaptation the guitar to the invention.

Further objects and advantages of my invention will become apparent from a consideration of the drawings and ensuring description.

DRAWING FIGURES

FIG. 1 is a perspective view of a Acoustic Arm in accordance with the invention.

FIG. 2 is a top plan view with conventional breaks taken along lines 2—2 of FIG. 1

FIG. 2A is a cross sectional view taken along lines 2A—2A of FIG. 2

Reference Numerals In Drawings

Figure 3:
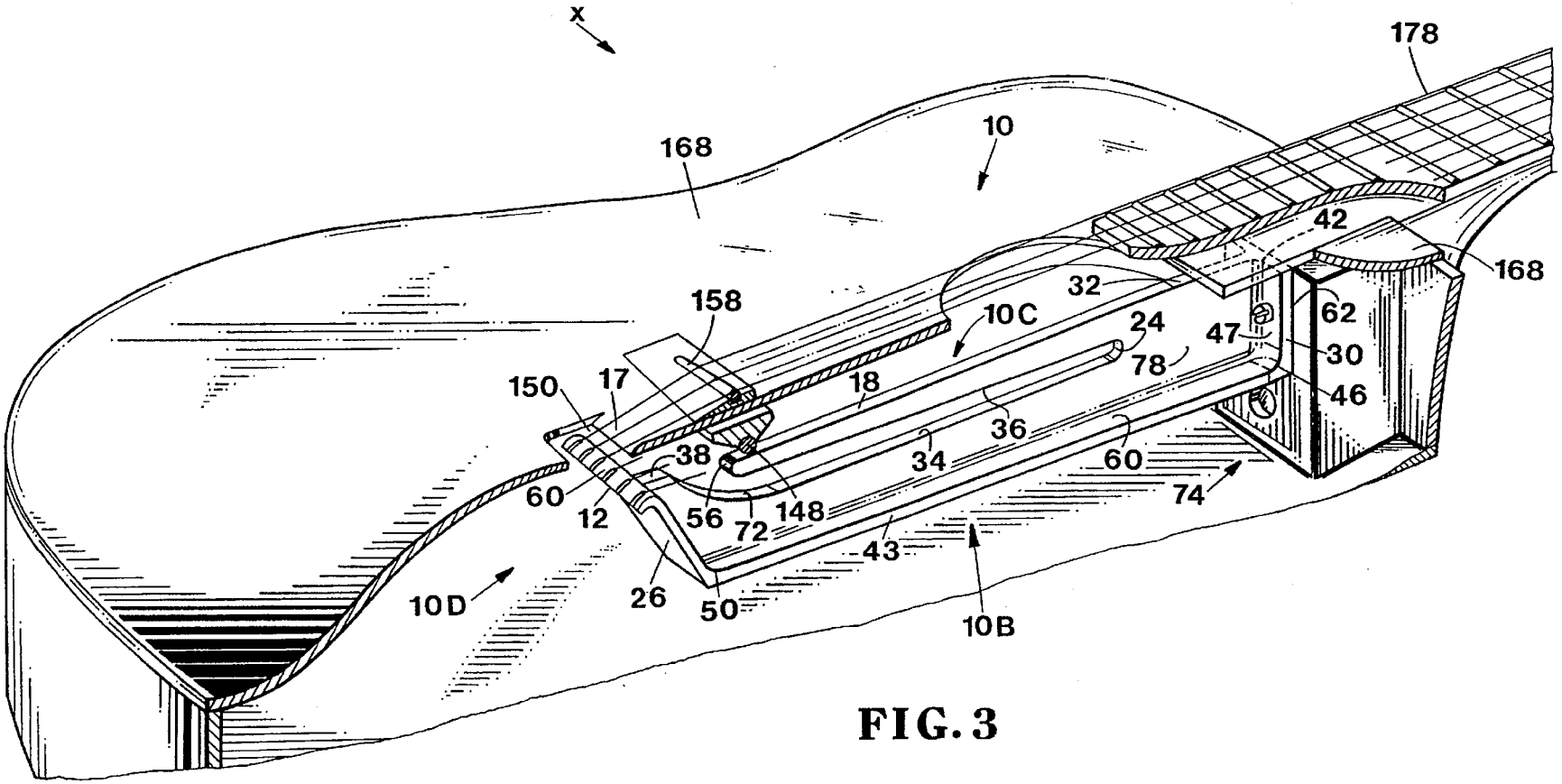
FIG. 3 is a perspective view of adaptation a guitar for the invention and with the invention.

| | |
|---|---|
| 10 | acoustic arm |
| 10A | attach base |
| 10B | main lever |
| 10C | resonator |
| 10D | string hook |
| 11 | radius |
| 12 | end surface |
| 12A | twelfth fret |
| 14 | six strings slits |
| 15 | radius |
| 16 | round off |
| 17 | round surface |
| 18 | resonator top surface |
| 19 | hidden lines |
| 20 | bottom lever surface |
| 21 | connection line |
| 23 | connection surface |
| 24 | internal radius surface |
| 25 | connection surface |
| 26 | hook surface |
| 27 | hole surface |
| 28 | side surface |
| 30 | side surface |
| 32 | top base surface |
| 34 | top lever surface |
| 36 | bottom resonator surface |
| 38 | top plane |
| 40 | interconnection radius |
| 41 | side lever surface |
| 42 | interconnection radius |
| 43 | side lever surface |
| 44 | interconnection radius |
| 45 | base surface |
| 46 | interconnection radius |
| 47 | base surface |
| 48 | radius |
| 50 | radius |
| 52 | interconnection radius |
| 53 | interconnection radius |
| 54 | interconnection radius |
| 55 | interconnection radius |
| 56 | resonator round end surface |
| 58 | bottom round off |
| 60 | horizontal lever surface |
| 62 | back base surface |
| 64 | circular through aperture |
| 68 | circular through aperture |
| 69 | inner block surface |
| 71 | side block surface |
| 72 | connection round surface |
| 73 | side block surface |
| 74 | top block |
| 75 | front block surface |
| 76 | resonator surface |
| 77 | bottom block surface |
| 78 | resonator surface |
| 79 | main block surface |
| 80 | front face |
| 81 | main block surface |
| 82 | heel neck |
| 83 | apertures for guitar tuners |
| 84 | front heel surface |
| 86 | bolt |
| 88 | bolt |
| 90 | connection rod |
| 91 | top surface |
| 92 | circular aperture |

-continued

| Reference Numerals In Drawings | |
|---|---|
| 93 | top surface |
| 94 | threaded through aperture |
| 95 | back block surface |
| 96 | threaded through aperture |
| 98 | threaded through aperture |
| 100 | main bolt |
| 104 | circular aperture |
| 106 | circular aperture |
| 108 | circular aperture |
| 110 | circular aperture |
| 112 | counterbore back aperture |
| 114 | circular aperture |
| 118 | locking pin |
| 120 | threaded sealed aperture |
| 122 | through circular aperture |
| 124 | heel neck bolt |
| 126 | strap button |
| 127 | button counterbore aperture |
| 128 | strap button circular aperture |
| 130 | circular aperture |
| 132 | outside rib surface |
| 135 | threaded through aperture |
| 136 | button |
| 137 | button radius |
| 138 | main portion bracing |
| 139 | bracing |
| 140 | main portion bracing |
| 141 | bracing |
| 142 | bracing |
| 143 | bracing |
| 144 | bracing |
| 145 | bracing |
| 146 | bridge |
| 147 | bracing |
| 148 | transfer pin |
| 149 | soundboard plate |
| 150 | hook hole |
| 152 | sealed aperture |
| 154 | sealed aperture |
| 156 | innercut line |
| 158 | saddle |
| 159 | nut |
| 160 | bottom surface |
| 162 | side heel surface |
| 164 | side heel surface |
| 166 | frond heel surface |
| 168 | soundboard |
| 169 | soundhole surface |
| 170 | open soundhole |
| 171 | soundhole surface |
| 172 | bottom heel surface |
| 173 | back fingerboard surface |
| 174 | fingerboard |
| 175 | front fingerboard surface |
| 176 | frets |
| 178 | string set |
| 180 | strings endings |
| 182 | back surface |
| 184 | soundbox |
| X | guitar |
| F1 | dynamic force |
| F2 | dynamic force |

DESCRIPTION—FIGS. 1 TO 9

Referring to the drawing, there is shown in FIG. 1 a acoustic arm 10 comprising a attach base 10A, a main lever 10B, a resonator 10C, a string hook 10D.

Attach Base 10A

As FIG. 1, 2A, 2 shows base 10A has a back base surface 62, portion of a top base surface 32, a side surface 28, a side surface 30, a base surface 45, a base surface 47, portion of a bottom lever surface 20, a circular through aperture 64, a circular through aperture 68.

Main Lever 10B

As shown in FIG. 1, 2A, 2 lever 10B has a top lever surface 34, portion of a resonator surface 76, portion of a horizontal lever surface 60, portion of a side lever surface 41, portion of a side lever surface 43, portion of a resonator surface 78, a top plane 38, a connection round surface 72, portion of surface 20.

Resonator 10C

As FIG. 1, 2A, 2 shows resonator 10C has a bottom resonator surface 36, portion of surface 76, a resonator top surface 18, portion of surface 78, a resonator round end surface 56.

String Hook 10D

As shows in FIG. 1, 2A, 2, hook 10D has portion of surface 60, portion of surface 41, portion of surface 43, a hook surface 26, a end surface 12, six string slits 14, portion of surface 20.

Acoustic Arm 10

As FIG. 1 shows surface 62 is connected with surface 32. Surface 18 is connected with surface 32 and with surface 56. Surface 36 is connected with surface 56 and with a internal radius surface 24. Surface 34 is connected with surface 24 and with surface 72. Plane 38 is connected with surface 72 and with surface 60, this is better illustrated in FIG. 2. As shows in FIG. 4 surface 20 is connected with surface 62 and with surface 26, which is formed by a bottom round off 58. As FIG. 1 shows surface 12 is connected to surface 60, which is formed by a top round off 16. As shows in FIG. 2 surface 62 is connected with surface 28 and surface 30. Surface 28 (FIG. 1) is connected with surface 32 and surface 41. Into surface 12 is connected surface 41 and surface 43.

As shows in FIG. 3 surface 43 is connected with surface 26, surface 60 and surface 30. A interconnection radius 42 is the connector between surface 78 and surface 47. Surface 47 is connected with surface 32 and with surface 30. Surface 32 is connected with surface 30 and surface 28.

Surface 28 is better illustrated in FIG. 1. A interconnection radius 46 is the connector between surface 47 and surface 60. As shows in FIG. 2A a interconnection radius 53 is the connector between surface 60 and surface 78. As FIG. 2 shows a interconnection radius 54 is the connector between surface 60 and surface 78.

As shows in FIG. 3 surface 78 is connected with surface 38, surface 72, surface 34, surface 24, surface 36 (FIG. 2A), surface 56, surface 18, surface 32. As shows in FIG. 1 surface 41 is connected with surface 26, surface 60, surface 28. A interconnection radius 40 is the connector between surface 76 and surface 45. Surface 45 is connected with surface 32 and with surface 28. A interconnection radius 44 is the connector between surface 45 and surface 60. As FIG. 2A shows a interconnection radius 55 is the connector between surface 60 and surface 76. As FIG. 2 shows a interconnection radius 52 is the connector between surface 60 and surface 76. As shows in FIG. 1,2 surface 41 comprise a radius 48 and is connected to surface 60. Surface 43 comprise a radius 50 (FIG. 3) and is connected to surface 60. Radius 48 and radius 50 forms surface 60 (FIG. 2). As FIG. 1 shows surface 76 is connected with surface 38, surface 72, surface 34, surface 24, surface 36 (FIG. 2), surface 56, surface 18, surface 32. As shows in FIG. 2A surface 20 is connected with surface 41, surface 28, surface 30 and surface 43. Surface 60 of hook 10D have slits 14 (FIG. 1).

Arm 10—Measurement

Figure 4:
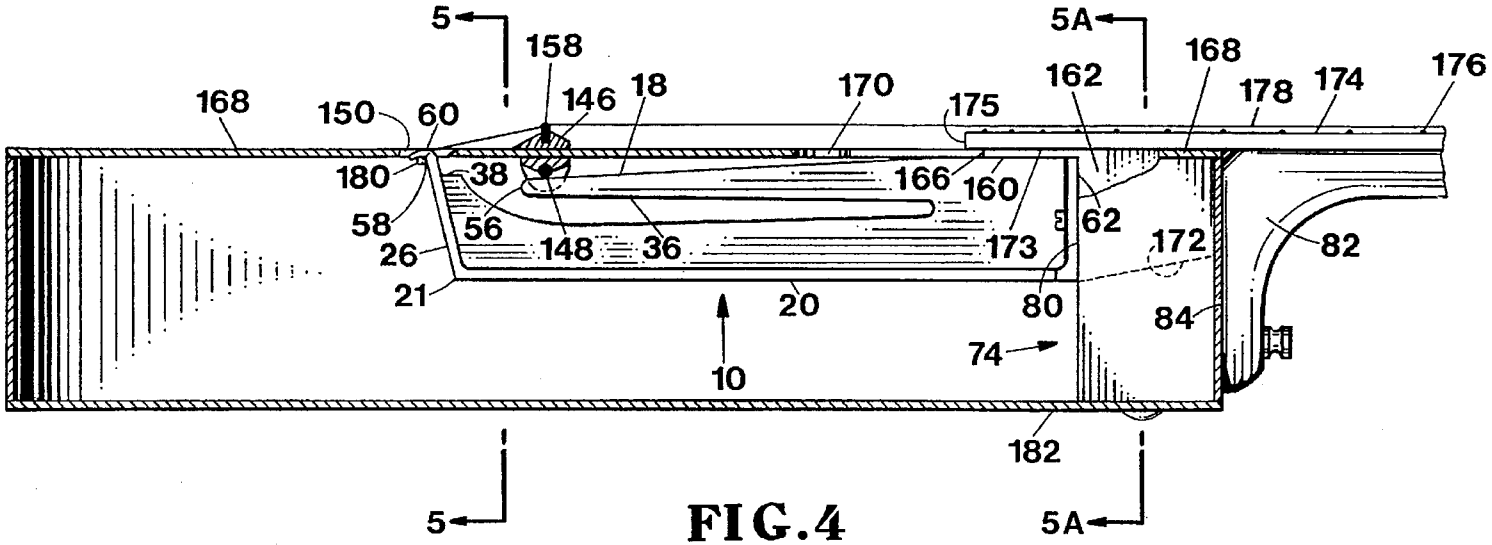
FIG. 4 is a view of FIG. 3 illustrating side position of adaptation of the guitar for the invention and with the invention.
Figure 4B:
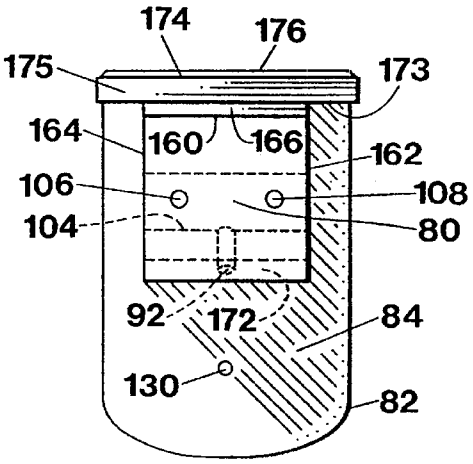
FIG. 4B is a front view of adaptation of the neck of a guitar to the invention.
Figure 9:
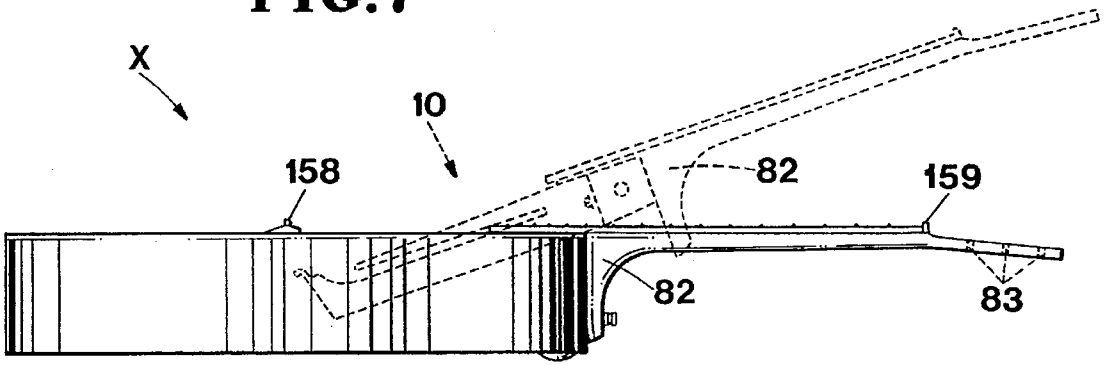
FIG. 9 is a side view of the guitar showing the neck with invention assembly to the soundbox.

As shows in FIG. 9 length of arm 10 is dependent on the scale length of a guitar X. The scale length is distance between a saddle 158 and a nut 159. As shows in FIG. 3, distance between saddle 158 and surface 12 is not less than 1¾", plus distance between saddle 158 and surface 62 is length of arm 10. Width of base 10A (FIG. 2A) is distance between surface 28 and surface 30, this distance is less than 1/16" from width of a front face 80 (FIG. 4B). Height of base 10A (FIG. 2A) is distance between surface 32 and surface 20, this distance is less than 1/16" from height of face 80 (FIG. 4B).

As shows in FIG. 2A horizontal axis of aperture 64 and aperture 68 is in a middle of a distance between surface 32 and surface 20. Vertical axis of aperture 64 is in a middle of a distance between surface 28 and surface 76. Vertical axis of aperture 68 is in a middle of a distance between surface 30 and surface 78. As FIG. 2 shows distance between surface 62 and surface 45 and surface 47 is no less than ⅛". Radius 40 is less than ⅛" and radius 42 is less than ⅛". Radius 44 (FIG. 1) is no less than ¼" and radius 46 (FIG. 3) is no less than ¼". As FIG. 2 shows longitudinal axis comprised between surface 76 and surface 78 is perpendicular to surface 62. Longitudinal axis comprised between surface 76 and surface 78 is in a middle of a distance between surface 28 and surface 30.

Surface 76 and surface 78 are perpendicular to surface 60. Distance between surface 76 and surface 78 is no less than ⅛", and distance between surface 60 and surface 20 (FIG. 2A) is no less than ⅛". Surface 20 and surface 60 are parallel. As shows in FIG. 2 difference of narrowing lever 10B is less than ⅜" from width base 10A. The length of narrowing lever 10B is a distance between surface 62 and a connection line 21 and the distance is less than length of arm 10 but, no less than half the distance of plane 38. The narrowing of lever 10B is symmetrical in relation to line 21. From line 21 surface 26 and surface 60 are on the slant to outside with angle between 95°–110°, which is comprised between surface 20 and surface 26 (FIG. 4).

Radius 48 (FIG. 1,2) is no less than ¼" and radius 50 (FIG. 2,3) is no less than ¼". As shows in FIG. 1 distance between surface 60 and surface 26 is no less than ⅛ and reduces to surface 12. The distance between surface 60 and surface 26 in place where is connected surface 12 is less than ⅛. Round off 58 is formed to a strings endings 180 (FIG. 4). As FIG. 1 shows width of hook 10D is distance between surface 41 and surface 43 in place of connection to surface 12. Width of hook 10D (FIG. 3) is smaller, but not less than ½" from the distance between two outer strings of set 178 located on saddle 158. Saddle 158 is better illustrated in FIG. 7.

The distance between strings 178 (FIG. 5) located on saddle 158 is dependent to the dimensions and size of guitar X. As shows in FIG. 4 height of hook 10D is between molded surface 60 by round off 16 (round off 16 is better illustrated in FIG. 1) and surface 20 of lever 10B. Height of hook 10D is same as height of base 10A plus thickness of soundboard 168.

As FIG. 1 shows, hook 10D contains string slits 14, which are open from surface 12 and passing through surface 60 and surface 26. Slits 14 are equal distance from each other. The distance of one outer slit 14 to surface 41 is half of the distance between slits 14 and the distance of second outer slit 14 to surface 43 is half of the distance between slits 14. Slits 14 lengths are not less than ¼", and slits 14 distances are between surface 12 and hidden lines 19 (FIG. 1). Widths of slits 14 have normalized dimensions, relevant to thickness of each string in stringt set 178. This means thad slits 14 can not be wider than strings endings 180. As FIG. 2 shows, the length of plane 38 is between ¼ and ¾". The distance between plane 38 and surface 20 (FIG. 4) is smaller than height of base 10A, but not less than ⅜". The distance between surface 56 and surface 72 (FIG. 1) is not less than ⅜. As shows in FIG. 1,4 distance between surface 36 and surface 18 in place of connection to surface 56 is not less than ⅛". Radius of surface 24 (FIG. 1) is less than ⅛". The distance between surface 24 and surface 62 (FIG. 1,2) is not less than 1½". Surface 32 is parallel to surface 20 (FIG. 2A) and perpendicular to surface 62 (FIG. 2). The distance between surface 62 and surface 18 is a length of surface 32 and is not less than 1½" (FIG. 1). Surface 18 (FIG. 4) is slanted between 1° and 10°. The distance between surface 24 (in place of connection surface 24 to surface 34) and surface 20 is greater than half of height of base 10A, but less than ⅛" (FIG. 2A).

Heel Neck 82

As shows in FIG. 4 and 4B, a front face 80 of neck 82 having a circular aperture 106 and a circular aperture 108 (FIG. 4B). A bottom heel surface 172 is connected to a front heel surface 84 and to face 80. A bottom surface 160 is connected to face 80 and to a front heel surface 166, also surface 166 is connected with a back fingerboard surface 173. A front fingerboard surface 175 is connected with surface 173 and connected to a fingerboard 174, on which frets 176 are located. A side feel surface 162 is connected with face 80, surface 84, surface 173, surface 160, surface 166, surface 172. A side heel surface 164 is connected with face 80, surface 84, surface 173, surface 160, surface 166, surface 172 (FIG. 4,4B). As shows in FIG. 4B,5A, surface 162 having a circular aperture 104, which is through and perpendicular to surface 162 and surface 164. Aperture 106 and aperture 108 of face 80 are connected with aperture 104.

As FIG. 4B shows neck 82 having a circular aperture 130, which is trough and perpendicular to surface 84. As shows in FIG. 4B,5A,6 surface 172 having a circular aperture 92, which is connected with aperture 104 and is parallel to face 80 and also perpendicular to aperture 104. Face 80 is parallel to surface 84 and surface 166. As FIG. 4,4B shows face 80 is perpendicular to surface 164, surface 162, surface 160, surface 173. Surface 172 is perpendicular to surface 162, surface 164. As shows in FIG. 6 surface 172 is slantingly connected to face 80 and surface 84. As shows in FIG. 5A in middle of distance between surface 164 and surface 162 is aperture 92. Neck 82 (FIG. 4,9) in lower portion has normal shape in its body.

Heel Neck 82—Measurement

As shows in FIG. 4B distance between surface 164 and surface 162 is width of face 80, and is not less than 1½". The distance between surface 160 and surface 172 (in place where surface 172 is connected to face 80) is height of face 80 and is not less than 2". As shows in FIG. 6 comprised angle between face 80 and surface 172 is between 65° and 85°. The distance between face 80 and surface 84 is greater from length of a top block 74 by distance between a back block surface 95 and a outside rib surface 132.

Figure 5A:
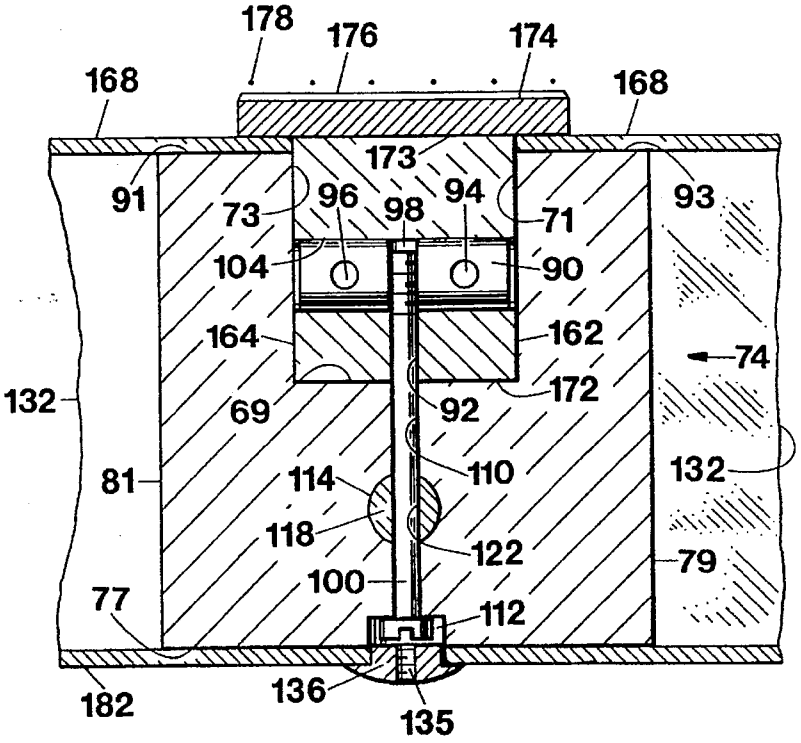
FIG. 5A is a cross sectional view taken along lines 5A—5A of FIG. 4.
Figure 5:
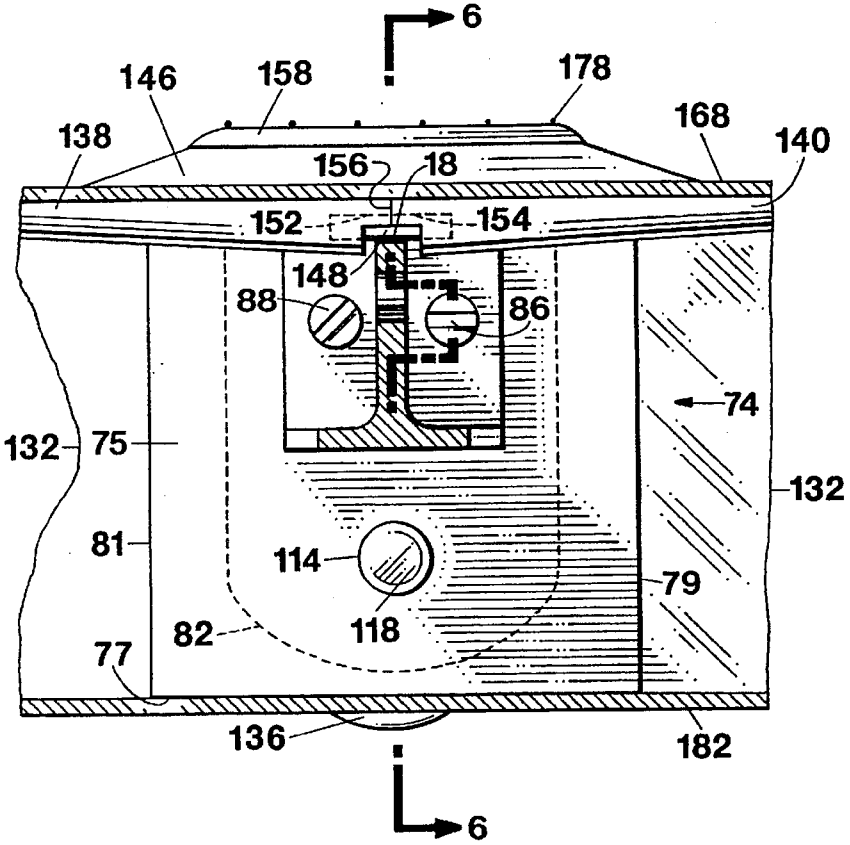
FIG. 5 is a cross sectional view taken along lines 5—5 of FIG. 4.
Figure 6:
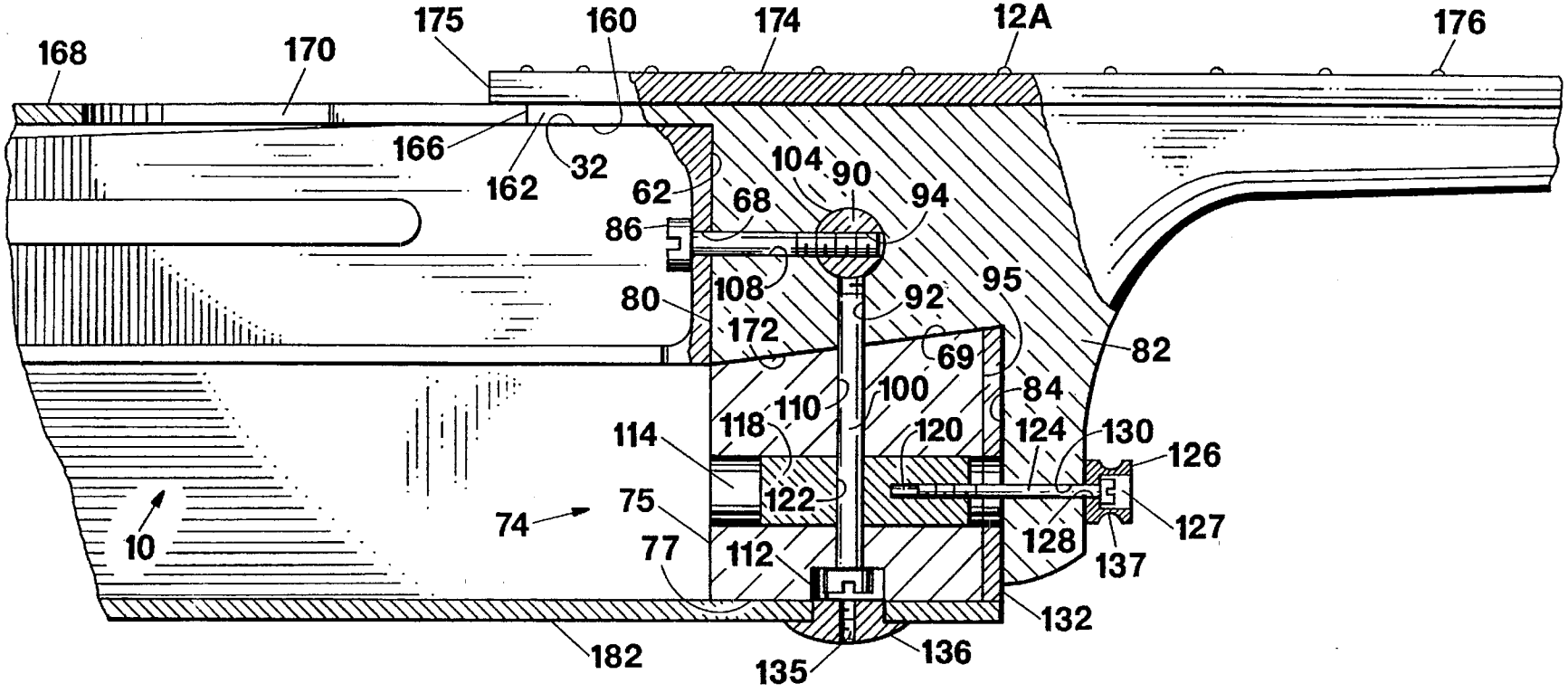
FIG. 6 is a cross offset sectional view taken along lines 6—6 of FIG. 5.

As shows in FIG. 6 distance between surface 175 and surface 166 is not less than ½". Thickness of surface 132 is between 3/64" and ¼" and is dependent on the construction of guitar X. The thickness of surface 166 (FIG. 4,4B) is comprised between surface 173 and surface 160. Surface 166 has a thickness of a soundboard 168, which is between 3/32" and 5/32". The distance between soundboard 168 and surface 173 (FIG. 5A) is less than 1/16". As shows in FIG. 4B width of surface 84 is width of a fingerboard 174 in place where is located a twelfth fret 12A (FIG. 6). Width of neck 82 is smaller than width of block 74 shown in FIG. 5 in which neck 82 is marked with hidden lines.

As shows in FIG. 6 length of neck 82 is describes from the place, where is located fret 12A and to the end of surface 84

(opposite end of connection surface 82 with surface 69). From the end of surface 84 to a back surface 182 the distance is not less than ¼". As FIG. 4B shows, distance between surface 160 and horizontal axis of aperture 106 and aperture 108, is same as distance between surface 32 and horizontal axis of aperture 64 and aperture 68 of base 10A (FIG. 2A). The distance between aperture 106 and aperture 108 is same as distance between aperture 64 and aperture 68 of base 10A (FIG. 2A). Half the distance between aperture 106 and aperture 108 is in a vertical axis of symmetry of neck 82, the same as face 80 (FIG. 4B).

As shows in FIG. 5A horizontal axis of a threaded through aperture 96 and a threaded through aperture 94 are in longitudinal axis of a connection rod 90. The middle of a distance between aperture 96 and aperture 94 is in a middle of length of rod 90. The middle of length of rod 90 having a threaded through aperture 98, which is perpendicular to aperture 96 and aperture 94. Longitudinal axis of aperture 98 is in the middle of length of rod 90. The distance between aperture 96 and aperture 94 is same as distance between aperture 64 and aperture 68 of base 10A (FIG. 2A). As shows in FIG. 4B horizontal axis of aperture 106 and aperture 108 is in the longitudinal axis of aperture 104. In aperture 104 is located rod 90 (FIG. 5A,6).

As FIG. 6 shows, distance between face 80 and vertical axis of aperture 92 is same as distance between face 80 and vertical axis of aperture 104. As shows in FIG. 5A in a middle of a distance between surface 164 and surface 162 is located aperture 92, which is perpendicular to aperture 104 and parallel to surface 162 and face 80. As shows in FIG. 4B, vertical axis of aperture 130 is in vertical axis of symmetry of neck 82. As FIG. 6 shows longitudinal axis of aperture 130 is in the longitudinal axis of aperture 114 of block 74.

Block 74

Figure 7A:
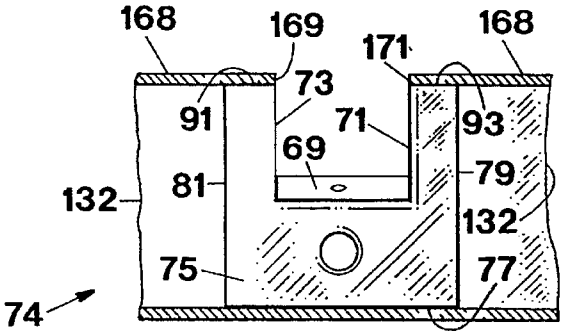
FIG. 7A is a cross sectional view taken along lines 7A—7A of FIG. 7.
Figure 7:
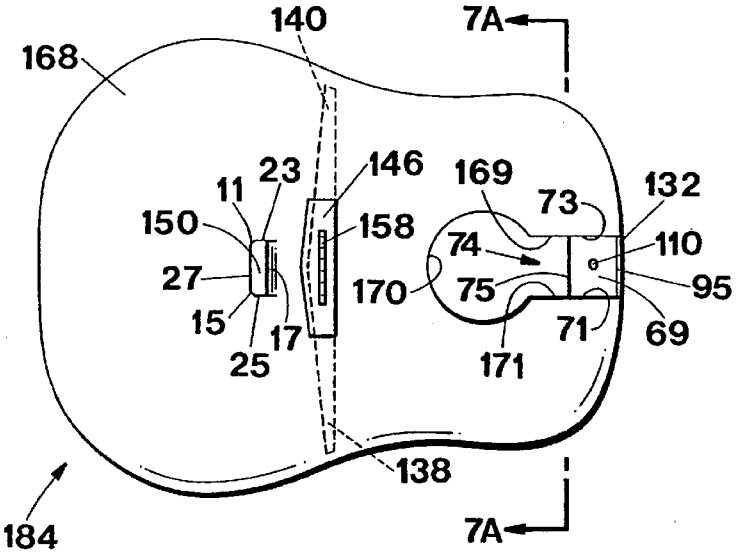
FIG. 7 is a top plane view of adaptation of a guitar soundbox for invention taken from FIG. 3.

As shows in FIG. 7 block 74 of a soundbox 184 has surface 69, which is connected to a side block surface 71 and with a side block surface 73. A top surface 91 (FIG. 7A) is connected to a main block surface 81, and a top surface 93 is connected with a main block surface 79. A front block surface 75 is connected with surface 81, surface 91, surface 73, surface 69, surface 71, surface 93, surface 79. As shows in FIG. 6,7 surface 95 is connected with surface 81 (FIG. 7A), surface 91, surface 73, surface 69, surface 71, surface 93, surface 79. As FIG. 7A shows, a bottom block surface 77 is connected to surface 81, surface 75, surface 79, surface 95 (FIG. 6).

As shows in FIG. 7A, surface 77 is parallel to surface 91 and surface 93. Surface 77 is perpendicular to surface 81, surface 79, surface 75, surface 95 (FIG. 6). As FIG. 7A shows surface 73 is perpendicular to surface 91 and parallel to surface 71. Surface 93 is perpendicular to surface 71. Surface 69 is slantingly connected to surface 73 and surface 71, also surface 69 is perpendicular to surface 73 and surface 71. As shows in FIG. 6, surface 69 has a circular aperture 110, which is connected to a counterbore back aperture 112 by aperture 114. Aperture 112 is located in surface 77 and surface 182. Surface 75 has a circular aperture 114, and passing through surface 95 to surface 132.

Block 74—Measurement

As shown in FIG. 5A, distance between surface 81 and surface 79 is a width of block 74. Width of block 74 is greater from width of fingerboard 174 (in place, where is fret 12A) not less than ⅜ (FIG. 6). Length of block 74 (FIG. 6) is a distance between surface 95 and surface 75 and is not less than 1½". As FIG. 7A shows, distance between surface 77 and surface 91 with surface 93 is a height of block 74 (surface 91 and surface 93 are same height). Height of block 47 is between 3" and 6" and is dependent on the dimensions and size of guitar X.

As FIG. 7A shows the space of block 74, which is between surface 73 and surface 71, this distance is the width of the space of block 74. The distance between surface 73 and surface 71 is same as width of face 80 of neck 82 (FIG. 4B). Distance between surface 81 and surface 73 is same as distance between surface 71 and surface 79. As shows in FIG. 7A height of space of block 74 describes layout of surface 69. Distance between surface 69 (in place of connection to surface 75) and surface 91 with surface 93 is same as height of face 80 (FIG. 4B). Distance between surface 69 (in place of connection to surface 95, FIG. 6) and surface 91 with surface 93 (FIG. 7A) is smaller than height of face 80 (FIG. 4B). As shows in FIG. 6 comprised angle between surface 69 and surface 95 is same as angle comprised between face 80 and surface 172 of neck 82.

As shown in FIG. 6 distance between surface 75 and vertical axis of aperture 110 is same as distance between vertical axis of aperture 110 and surface 95. Aperture 110 is parallel to surface 75 and surface 79 (FIG. 5A). Distance between vertical axis of aperture 110 and surface 75 is same as distance between face 80 and vertical axis of aperture 92 of neck 82 (FIG. 6).

As FIG. 5A shows, in a middle of a distance between surface 81 and surface 79 is located aperture 110, which is connected to aperture 114 in the axis of symmetry of aperture 114. As shows in FIG. 6 longitudinal axis of aperture 114 is a middle of distance between surface 182 and surface 69 (in place of connection surface 69 and surface 75).

Aperture 114 is perpendicular to aperture 110. As shows in FIG. 6 aperture 112 is connected to aperture 110 in longitudinal axis of aperture 110. A through circular aperture 122 of a locking pin 118 is perpendicular to a threaded sealed aperture 120 of pin 118. Aperture 122 is in perpendicular axis of pin 118 (FIG. 5A) and aperture 120 is in longitudinal axis of pin 118 (FIG. 6). Pin 118 is located in aperture 114 (FIG. 5A,6).

Separable Connection Between Neck 82 and Block 74

As shows in FIG. 5A,6 surface 172 of neck 82 and surface 69 of block 74 are connection by a main bolt 100. Bolt 100 is screwed in a threaded through aperture 98 (FIG. 5A) of rod 90 by aperture 112, aperture 110, aperture 122 of pin 118 and aperture 92 of neck 82 (FIG. 6). Bolt 100 is covered by a button 136, which having a threaded through aperture 135. As FIG. 6 shows a heel neck bolt 124 connected surface 84 of neck 82 with surface 132 of guitar X. Bolt 124 is screwed in aperture 120 of pin 118 by a button counterbore aperture 127, a strap button circular aperture 128 of a strap button 126, aperture 130 of neck 82, aperture 114 of block 74.

Separable Connection Between Neck 82 and Block 74—Measurement

As shows in FIG. 5A length of rod 90 is smaller than distance between surface 164 and surface 162 not less than 1/16". Diameter of rod 90 is not less than ½". As FIG. 6 shows diameter of aperture 104 is greater than diameter of rod 90 not less than 0.015". Diameters of aperture 92, aperture 110, aperture 122, are greater than diameter of bolt 100 not less than 0.015". Diameter of aperture 130 is greater than bolt 124 not less than 0.015". Length of pin 118 is not less than 1". Diameter of pin 118 is not less than ½". Distance between vertical axis of aperture 122 and end of pin 118 (opposite end of pin 118 where is aperture 120) is less than ¼".

Length of aperture 120 is less than ⅜". Diameter of aperture 114 is greater than diameter of pin 118 less than 0.015. As shows in FIG. 6 the shortest distance between aperture 114 and aperture 112 is not less than ¼". Diameter of aperture 112 is dependent on the head of bolt 100 and greater than head of bolt 100. Diameter of aperture 112 is fitted to diameter of button 136, which is pressed into aperture 112 not less than ⅛" depth. The most greater diameter of button 136 is not less than 1". Depth of aperture 112 is greater than height of head of bolt 100 not less than ¼".

Adaptation of Soundboard 168 to Arm 10

As shows in FIG. 7 a open soundhole 170 having circular shape, which is open in portion to surface 132. Created space between a soundhole surface 169 and a soundhole surface 171 of soundhole 170 makes visible a portion of comprised aperture 110, which axis of symmetry is in longitudinal axis of soundboard 168. Surface 169 is parallel to surface 171 and distance between surface 169 and surface 171 is the same as distance between surface 73 and surface 71 of block 74, this also illustrated FIG. 7A. As shows in FIG. 7 length of surface 169 and surface 171 is between 4" and 7" and a distance is between circumference of soundhole 170 (in place of connection surface 169 and surface 171 to circumference of soundhole 170) and surface 132.

Diameter of soundhole 170 is between 3"–5" and is dependent on the dimensions and size of guitar X. Soundhole 170 is in longitudinal axis of soundboard 168. As FIG. 7A shows surface 132 having formed space between surface 73, surface 69, surface 71 of block 74 and it is a continuation of space created by surface 169 and surface 171 of soundhole 170 (FIG. 7). As shows in FIG. 7 a bridge 146 and saddle 158 incorporate conventional parameters based on the scale length of guitar X. A hook hole 150 has in its own shape radius 11, a radius 15, a round surface 17, which is better illustrated in FIG. 3.

As shows in FIG. 7 a connection surface 23 is parallel to a connection surface 25 and a hole surface 27 is parallel to surface 17. Surface 25 is perpendicular to surface 27. Radius 11 and radius 15 are less than 1/16". As FIG. 7 shows distance between surface 25 and surface 23 is not less than ¼" from width of hook 10D of arm 10 (FIG. 1). Distance between surface 27 and surface 17 is not less than ¼" from distance between lines 19 and surface 12 of hook 10D (FIG. 1). Distance between surface 27 and saddle 158 dependent on the length of arm 10 (FIG. 7). Hole 150 passing through soundboard 168 and a soundboard plate 149 (FIG. 8).

Bottom of Soundboard 168

Figure 8:
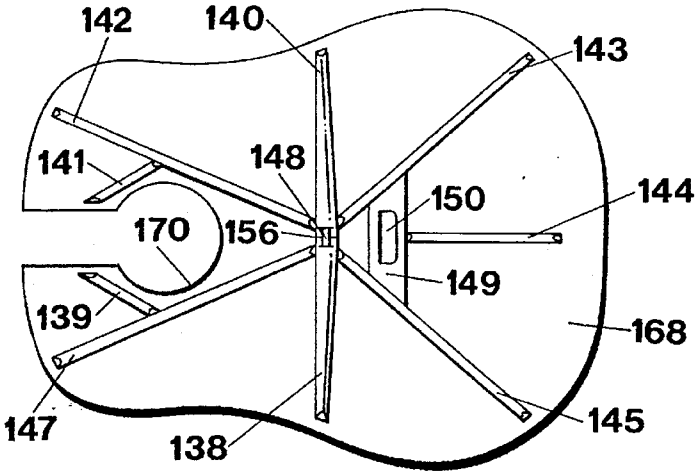
FIG. 8 is a bottom plane view of adaptation of a guitar soundboard taken from FIG. 7.

As shows in FIG. 8 bottom of soundboard 168 has a main portion bracing 138, a transfer pin 148, a mine portion bracing 140, a bracing 143, bracing 144, a bracing 145, a bracing 147, bracing 139, a bracing 141, a bracing 142, plate 149. Bracing 149 and bracing 140 are perpendicular to longitudinal axis of symmetry of soundboard 168 and having pin 148. Pin 148 is located in longitudinal axis of bracing 138 and bracing 140. A innercut line 156 is perpendicular to longitudinal axis of bracing 138 and bracing 140. Line 156 localize half of the length of pin 148 and the same length of bracing 138 and bracing 140.

Soundboard 168—Measurement

As shows in FIG. 7 bracing 138 and bracing 140 are connected to bottom of soundboard 168 in longitudinal axis of saddle 158. Bracing 144 is located in longitudinal axis of soundboard 168 (FIG. 8).

Angle between bracing 144 and bracing 145 is between 35°–50°.

Angle between bracing 144 and bracing 143 is between 35°–50°.

Angle between bracing 138 and bracing 147 is between 50°–60°.

Angle between bracing 140 and bracing 142 is between 50°–60°.

Angle between bracing 147 and bracing 139 is between 50°–60°.

Angle between bracing 142 and bracing 141 is between 50°–60°.

The length and rest of dimension of bracing 141, bracing 142, bracing 143, bracing 144, bracing 145, bracing 147, bracing 139 are dependent on the dimensions, size and shape of guitar X. Height of bracing 138 and bracing 140 is not less than ½" in line 156 and reduces to facing ends not less than ⅛". Width of bracing 138 and bracing 140 in line 156 is not less than ½" and reduces to facing ends not less than ⅛". Length of bracing 138 and bracing 140 is dependent on the dimensions, size and shape of guitar X.

Diameter of pin 148 is not less than ⅛" and length of pin 148 is not less than 1" (FIG. 5). Longitudinal axis of a sealed aperture 152 of bracing 138 is in longitudinal axis of a sealed aperture 154 of bracing 140. Longitudinal axis of symmetry of bracing 138 and bracing 140 is in line 156 (FIG. 5,8).

As shown in FIG. 5 aperture 152 and aperture 154 have pin 148, which is visible in formed space of bracing 138 and bracing 140. The formed space is in shape of rectangle, which the half of length is not less than 3/16" from line 156 (FIG. 5,8). The depth of formed space is the half of diameter of pin 148 (FIG. 5). The thickness of soundboard 168 is between 3/32–5/32 and is dependent on the dimensions and size of guitar X.

OPERATION

Method of Incorporation Pin 148

As shows in FIG. 5 incorporation of pin 148 in bracing 138 and bracing 140 is an operation, which involves making aperture 152 and aperture 154 in bracing 138 and bracing 140 for pin 148. Next, by removing excess of wood from bracing 138 and bracing 140, a fitted piace for pin 148 is created. Connected brecing 138 and bracing 140 in line 156 with pressed in pin 148 inside aperture 152 and aperture 154, and attached to bottom of soundboard 168, sed pin 148 in place. Diameter of aperture 152 and aperture 154 are grater than diameter of pin 148, but no grater than space reqired to eliminate excess air from pushing in pin 148.

Attachment of Arm 10 Go guitar X and Function of Elements

As shows in FIG. 6 attachment of arm 10 to neck 82 makes facile separable connection between neck 82 and block 74, which has a wedge shape fitted to wedge shaped neck 82. Block 74 is a inseparable portion of the soundbox 184. Surface 32 of arm 10, which clings to surface 160 of neck 82. Base 10A of arm 10 is attached to face 80 by bolt 86 and bolt 88. Bolt 88 (FIG. 5) is screwed into aperture 96 (FIG. 5A) of rod 90 through aperture 64 of arm 10 and aperture 106 of face 80 (FIG. 4B).

As shown in FIG. 6, bolt 86 is screwed into aperture 94 of rod 90 through aperture 68 of arm 10 and aperture 108 of face 80. FIG. 6 shows bolt 124 secure bolt 100 from evetuality unscrewing, by pressing bolt 100 through aperture 122 of pin 118 to the surface of aperture 110. Pin 118 is not in contact with surface 84. Button 126 is also a washer under the head of bolt 124. Rod 90 is a connector between bolt 100, bolt 86 and bolt 88. Bolt 86 and bolt 88 attach arm 10 to face 80 of neck 82.

As shows in FIG. 9 neck 82 with attached arm 10 is inserted into soundbox 184, through soundhole 170 (FIG. 7) to block 74 attaching neck 82 through bolt 100 and bolt 124 (FIG. 6). Bolt 100 and bolt 124 is shown in FIG. 6. Bolt 100 is screwed in first, then bolt 124 is screwed in. As shows in FIG. 6 surface 69 and surface 172 are pressed together by bolt 100, and surface 84 pressed to surface 132 by bolt 124, create a rigid enough and separable construction between soundbox 184 and neck 82 (FIG. 9). In this situation (FIG. 3,4,5) surface 18 is in contact with pin 148 and hook 10D is visible in hole 150, and does not touch hole 150 (FIG. 3,4). Place in which arm 10 is in contact with soundboard 168 is pin 148 which is an integral portion of soundboard 168. Next procedure (FIG. 3) is the attachment of string set 178 in slits 14 arrangement of string set 178 on saddle 158, and attachment of tuners to the guitar (not shown), with are in apertures 83 in a conventional construction (FIG. 9). Note; guitar tuners—device for string tension adjustment in a guitar.

Method of Arm 10 Functionality in Scheme of Outside Dynamic Forces

Figure 4A:
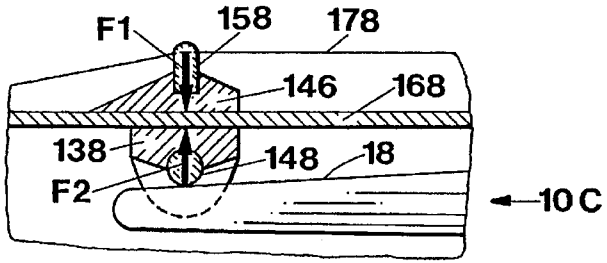
FIG. 4A is a fragmentary side and sectional view of a guitar and the invention, illusrtrating scheme of operating outside dynamic forces.

According to the above, relocation of attachment of a string set 178 to hook 10D of arm 10 (FIG. 3,4) creates a better scheme of operating outside dynamic forces, cooperating with soundboard 168. FIG. 3,4 shows attached to hook 10D and stretched (guitar in tune), string set 178, propped by saddle 158. As shown in FIG. 4A in place of support of string set 178 by saddle 158 force F1 is created. Force F1 acts in direction of soundboard 168 through saddle 158 and bridge 146. In place where surface 18 of resonator 10C meets pin 148 of soundboard 168, which is under influence of force F1, force F2 is created.

Source of force F2 is F1 and natural material strength, as well as, flexibility of resonator 10C. Force F2 actc in opposite direction of F1. Force F2 acts on the bottom of soundboard 168 through pin 148 and bracing 138, as well as, bracing 140, bracing 140 is illustrated in FIG. 5,7,8. Resonator 10C (FIG. 4A) dictates behavior of force F2, to point of balance of force F1 and force F2. Point of balance of acting upon each other forces F1 and F2 is soundboard 168. FIG. 4A illustrates direction of acting forces, F1 and F2, with arrows.

In this arrangement a tug on string (s) by player, creates a disturbance of balance of forces F1 and F2 acting upon soundboard 168. Excited vibrations of soundboard 168 by forces F1 and F2, produce more full and open sound of guitar X, compared to a conventional system, in which strings are attached to soundboards of those guitars.

Materials, Remaining Dimensions, Tolerances

Strength and flexibility of arm 10 is related to the bend of lever 10B and to height of hook 10D, in relation soundboard 168 with stretched strings 178 in guitar X. According to (FIG. 3,4) surface 60 formed by round off 16 sticks out above soundboard 168 no more than 1/16". Establishment of the bend of lever 10B is possible by increasing thickness of lever 10B or usage of better material to form arm 10. Size and amount of strings (twelve strings guitar) used in the guitar also has influence on the bend of lever 10B. Tolerance of bend of soundboard 168 in longitudinal axis of bracing 138 and bracing 140, (guitar in tune) is +0.000" and 0.016". In order to obtain area of above cited tolerance, dimensions of resonator 10C, bracing 138, bracing 140 and used material to forming arm 10, should be carefully thought through. To obtain the area of cited tolerance one should use a dial indicator with tolerance ±0.001", (indicator applied) in the middle of saddle 158 in a tuned guitar.

Padding for slits 14 of hook 10D (in place of formed surface 26 by round off 58, [FIG. 1]) will prevent eventual denting of material by string endings 180. Material used to form arm 10 in this spot might be too soft. Preferred material for above padding is stainlee steel, with thickness between 1/32" and 3/32".Formed padding under slits 14 (described above), should not stick out beyond surface 41, surface 43 and surface 12. Every other hard enough material, can be used in the above mentioned. Pin 148 (FIG. 5) cooperating witch resonator 10C, prevents deformation of bracing 138, bracing 140, and it is an inseparable portion of bracing 138 and bracing 140. In result, pin 148 should be hard enough, preferred material for pin 148 is stainless steel. Diameter of bolt 86 and bolt 88 are not less than 3/16". Diameter of bolt 100 is not less than 1/4". Diameter of bolt 124 is not less than 1/8". Length of bolt 86, bolt 88, bolt 100 is described by threaded apertures, into which these bolts are screwed in. Ends of bolt 86, bolt 88, bolt 100 should not stick out beyond the ends of apertures. Length of bolt 124 describes distance between the end of aperture 120 inside pin 118 and end of aperture 127 of button 126.

Accordingly, screwed in portion of bolt 124 in aperture 120 does not touch the bottom (end) of aperture 120, leaving a distance not less than 1/8". Pin 118 (FIG. 6) does not came in contact with surface 84. Length of thread on bolt 124 is bigger, no more than 1/2", from length of thread in aperture 120 of pin 118. Length of thread on bolts 86, 88, 100, is bigger, but no more than 1/4" from depth or length of threadeds apertures, into which bolts 86, 88, 100 are screwed in. If aluminum is used in elements into which bolts 86, 88, 100, 124, are screwed in, than coarse threads are preferred.

As shown in FIG. 6 diameter of aperture 127 is greater, but no more than 1/16", than the head of bolt 124 and depth of aperture 127 is greater, no more than 1/8" than height of the head of bolt 124. A button radius 137 of button 126 is not greater than 3/32". Diameter of button 126 is greater than the head of bolt 124 less than 1/6". Distance between aperture 127 and radius 137 is not less than 1/16". Threaded aperture 135 of button 136 is helpful in extracting that element from aperture 112, into which it is pressed in. Preferred material for button 136 and button 126 is stainless steel. For block 74 and neck 82, preferred material is hard wood, i.e. maple. Formatted area, block 74, should contain in its dimensions tolerance accounting for the thickness of protective film on the wood, if this practice will be used.

It is preferred that arm 10 be formed of aluminum in a casting process, although other suitable materials and fabrication processes may be used. For example, aluminum alloy #2024 often called the aircraft alloy, because of its high strength Also usage of T-shape aluminum bar for lever 10B, and connection to its ends; base 10A and hook 10D is a good method. The aircraft aluminum alloy and soft steel are acceptable materials for rod 90, and pin 118.

Accordingly, above cited actions establish parameters of arm 10 for construction of guitar X, and are tied with serial (line) production, as well as optimal 100 percent utilization of arm 10. Arm 10 is preferred for production of guitars of different dimensions, sizes and shapes. Accordingly, rest of dimensions, parameters in this description are evident to those skilled on the art.

Summary, Ramifications, and Scope

Thus the reader will see that the invention Acoustic Arm provides a highly reliable, lightweig, yet economical device that can be used in new construction of guitar with soundbox. Therefore, the invention preserves same technique of playing and overall shape of the guitar. The most looked for characteristics of a new guitar being purchased are: sound, reliability and quality of the instrument. Low price guitars, in big percentage, deprived of these characteristics, because of many and known causes. Change for the better is evident in this invention. Benefits from the use of this invention is evident to all people interested in this field, and is an inspiration for progress in the field of guitar desing. While my above description contains many specifications, these should not be construed as limitations on the scope of the invention, but rather as an exemplification of one preferred embodiment thereof. Many other variations are possible.

For example:

( ) Use of arm 10 in different size mandolins, and interesting in violin.

( ) Through the use (on the inside) of material structure of arm 10 area filled with air, lighter weight is possible to achieved.

( ) Arm 10 can have two resonators 10C: one under thin strings and second under thick strings, interesting sound abilities of the instrument ( ) Use of plastic in production of arm 10 eliminates coloring, because plastic is available already in various colors. Besides, production of arm 10 from plastic filled with metal inside arm 10 can be stronger than aluminum.

( ) Method of use of epoxy resin strengthen fiber glass in production is worth a note.

( ) Use of arm 10 in electric guitars with soundbox, is practical and comfortable. Directly, on arm 10, attached pickup, of a simpler construction, eliminates necessary mechanisms for adjustment of normal pickup in relation of sound lever of individual string of a guitar.

( ) Also an interesting possibility of mechanical regulation, of length of sound, in guitar X, (FIG. 3) through installation in arm 10 of a insert between surfaces 34 and 36. Insert moved along surfaces 34 and 36, will shorten or lengthen sound.

( ) Next, is a useful (in guitars) mechanical element that creates effect "vibrato", which can be attached to hook 10D, or in different place of arm 10 permanently or not.

( ) Location of hook 10D, slanted, in combination with slanted resonator 10C, in relation to longitudinal axis of lever 10B of arm 10, will improve balance of high and low intonation of the instrument. Resonator 10C should be slanted right or left (thin or thick strings).

( ) Color of arm 10 is optional. Arm 10 can be produced as separate module or, an integral portion of the guitar's neck.

Accordingly, the scope of the invention should be determined not by the embodiment(s) illustrated, but by the appended claims and their legal equivalents.

I claim:

1. A stringed musical instrument comprising: a neck; a soundbox having an opening attached to said neck; a plurality of strings extending across said neck and said soundbox; an acoustic arm positioned within said soundbox; said arm including a lever extending from a first end to a second end; a hook member provided on said first end and extending through said opening; an end of each of said strings attached to said hook member; a base member provided on said second end; said base member attached to said neck; and a resonator extending from said base member toward said hook member and terminating in a free end; and means of separable connection between said neck and said soundbox of said musical instrument.

* * * * *